US010864729B2

(12) United States Patent
Sugai

(10) Patent No.: US 10,864,729 B2
(45) Date of Patent: Dec. 15, 2020

(54) DROPLET DISCHARGE HEAD, DROPLET DISCHARGE DEVICE, AND DROPLET DISCHARGE CONTROL METHOD OF DROPLET DISCHARGE DEVICE

(71) Applicant: Seiko Epson Corporation, Tokyo (JP)

(72) Inventor: Keigo Sugai, Chino (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/576,958

(22) Filed: Sep. 20, 2019

(65) Prior Publication Data

US 2020/0094555 A1 Mar. 26, 2020

(30) Foreign Application Priority Data

Sep. 21, 2018 (JP) ..... 2018-177077

(51) Int. Cl.
*B41J 2/14* (2006.01)

(52) U.S. Cl.
CPC ..... *B41J 2/14233* (2013.01); *B41J 2/1429* (2013.01)

(58) Field of Classification Search
CPC ..... B41J 2/14233; B41J 2/14274; B41J 2/04; B41J 2/04501; B41J 2/055; B41J 2/1429; B41J 2/14209
See application file for complete search history.

(56) References Cited

U.S. PATENT DOCUMENTS 5,933,168 A 8/1999 Sakai
2013/0182025 A1* 7/2013 Yanaka ..... B41J 2/04541 347/10

FOREIGN PATENT DOCUMENTS

JP H09-327909 A 12/1997

OTHER PUBLICATIONS

IP.com search (Year: 2020).*

* cited by examiner

*Primary Examiner* — Lisa Solomon
(74) *Attorney, Agent, or Firm* — Hamess, Dickey & Pierce, P.L.C.

(57) ABSTRACT

In a droplet discharge head, in an initial state in which a tip of the actuator has contact with the vibrating plate, and the actuator pushes the vibrating plate toward the first direction, based on a drive signal from the control section, the tip of the actuator displaces the vibrating plate toward the second direction in a state of having contact with the vibrating plate to thereby pull in a meniscus in the nozzle toward the liquid chamber, then, the tip of the actuator is separated from the vibrating plate to further displace the vibrating plate toward the second direction, and then, the tip of the actuator collides with the vibrating plate to thereby displace the vibrating plate toward the first direction to discharge the liquid from the nozzle.

10 Claims, 16 Drawing Sheets

DROPLET DISCHARGE HEAD, DROPLET DISCHARGE DEVICE, AND DROPLET DISCHARGE CONTROL METHOD OF DROPLET DISCHARGE DEVICE

The present application is based on, and claims priority from, JP Application Serial Number 2018-177077, filed Sep. 21, 2018, the disclosure of which is hereby incorporated by reference herein in its entirety.

BACKGROUND

1. Technical Field

The present disclosure relates to a droplet discharge head, a droplet discharge device equipped with the droplet discharge head, and a droplet discharge control method of the droplet discharge device.

2. Related Art

As a recording head for discharging a fine droplet, there can be cited, for example, one disclosed in JP-A-9-327909 (Document 1). In Document 1 mentioned above, there is disclosed a recording head for rapidly pulling in a meniscus m at rest in a nozzle opening to significantly displace a central region mc of the meniscus toward a pressure generation chamber, contracting the pressure generation chamber when the migration of the central region of the meniscus toward the pressure generation chamber is reversed to generate an inertial flow, and then making the inertial flow concentrically act on the central region of the meniscus close to the pressure generation chamber side to push only the central region out at high speed to thereby discharge a smaller ink droplet than the diameter of the nozzle opening.

However, when applying a high viscosity liquid no less than 50 mPa to the recording head described in Document mentioned above, the following problem arises. When discharging the high viscosity liquid no less than 50 mPa, the energy necessary to separate a droplet from the meniscus becomes higher compared to a related-art discharge liquid. Therefore, the recording head described in Document 1 is required to make a meniscus pull-in action in an early part of a discharge process larger in swing compared to when discharging the related-art liquid in order to increase an amount of energy of the piezoelectric vibrator supplied to the liquid. However, when the pull-in action becomes large in swing, the pressure in the liquid chamber is rapidly reduced, and therefore, there is a possibility that bubbles are generated in the liquid chamber to cause a discharge failure.

SUMMARY

A droplet discharge head is a droplet discharge head to be mounted on a droplet discharge device provided with a control section configured to perform discharge control of a liquid as a droplet, the droplet discharge head including a nozzle configured to discharge the liquid, a liquid chamber communicated with the nozzle, an inflow channel configured to supply the liquid chamber with the liquid, a vibrating plate constituting a part of a wall surface of the liquid chamber, and an actuator which can extend and contract to apply pressure to the liquid chamber via the vibrating plate, wherein defining a direction in which the vibrating plate is displaced so as to decrease a capacity of the liquid chamber as a first direction, and a direction in which the vibrating plate is displaced so as to increase the capacity of the liquid chamber as a second direction, in an initial state in which a tip part of the actuator has contact with the vibrating plate, and the actuator pushes the vibrating plate toward the first direction, based on a drive signal from the control section, the tip part of the actuator displaces the vibrating plate toward the second direction in a state of having contact with the vibrating plate to thereby pull in a meniscus in the nozzle toward the liquid chamber compared to the meniscus in the nozzle in the initial state, then, the tip part of the actuator is separated from the vibrating plate to further displace the vibrating plate toward the second direction, and then, the tip part of the actuator collides with the vibrating plate to thereby displace the vibrating plate toward the first direction to discharge the liquid from the nozzle.

The droplet discharge head described above may further include an elastic body configured to apply a force in the second direction to the vibrating plate.

The elastic body of the droplet discharge head described above may constitute a part of the wall surface of the liquid chamber.

The vibrating plate of the droplet discharge head described above may be a diaphragm.

The vibrating plate of the droplet discharge head described above may have a thick film part having contact with the actuator and disposed on a surface on an opposite side to the liquid chamber.

In the droplet discharge head described above, when the meniscus in the nozzle is pulled in toward the liquid chamber compared to the initial state, a diameter of a pseudo nozzle may be no less than ¼ and no more than ⅔ of a diameter of the nozzle.

The droplet discharge head described above may further include an outflow channel through which the liquid in either the liquid chamber or the nozzle is exhausted without passing through an opening of the nozzle.

A droplet discharge control method of a droplet discharge device is a droplet discharge control method of a droplet discharge device including a droplet discharge head having a nozzle configured to discharge the liquid, a liquid chamber communicated with the nozzle, an inflow channel configured to supply the liquid chamber with the liquid, a vibrating plate constituting a part of a wall surface of the liquid chamber, and an actuator which can extend and contract to apply pressure to the liquid chamber via the vibrating plate, a first tank configured to supply the liquid to the droplet discharge head via the inflow channel, a conveying mechanism configured to move the droplet discharge head and a recording medium relatively to each other, and a control section configured to control the droplet discharge head and the conveying mechanism. The method includes an initial state forming step of making, by the control section, a tip part of the actuator has contact with the vibrating plate, and the actuator push the vibrating plate toward a first direction defining a direction in which the vibrating plate is displaced so as to decrease a capacity of the liquid chamber as the first direction, and a direction in which the vibrating plate is displaced so as to increase the capacity of the liquid chamber as a second direction, a pull-in step of making, by the control section, the tip part of the actuator displaces the vibrating plate toward the second direction in a state of having contact with the vibrating plate to thereby pull in a meniscus in the nozzle toward the liquid chamber compared to the meniscus in the nozzle in the initial state forming step, a separation step of separating, by the control section, the tip part of the actuator from the vibrating plate to further displace the vibrating plate toward the second direction, and a discharge step of making, by the control section, the tip part of the actuator collides with the vibrating plate to thereby displace the vibrating plate toward the first direction to discharge the liquid from the nozzle.

In the droplet discharge control method of the droplet discharge device described above, in the discharge step, after making the actuator and the vibrating plate collide with each other, the control section may further displace the vibrating plate toward the first direction in a state in which the actuator and the vibrating plate have contact with each other to discharge the liquid.

A droplet discharge device includes the droplet discharge head described above, a first tank configured to supply the liquid to the droplet discharge head via the inflow channel, a conveying mechanism configured to move the droplet discharge head and a recording medium relatively to each other, and a control section configured to control the droplet discharge head and the conveying mechanism.

DESCRIPTION OF EXEMPLARY EMBODIMENTS

Some embodiments of the present disclosure will hereinafter be described with reference to the accompanying drawings. It should be noted that in each of the drawings hereinafter described, the scale sizes of the layers and the members are made different from the actual dimensions in order to make the layers and the members have recognizable dimensions.

Embodiment 1

Figure 1:
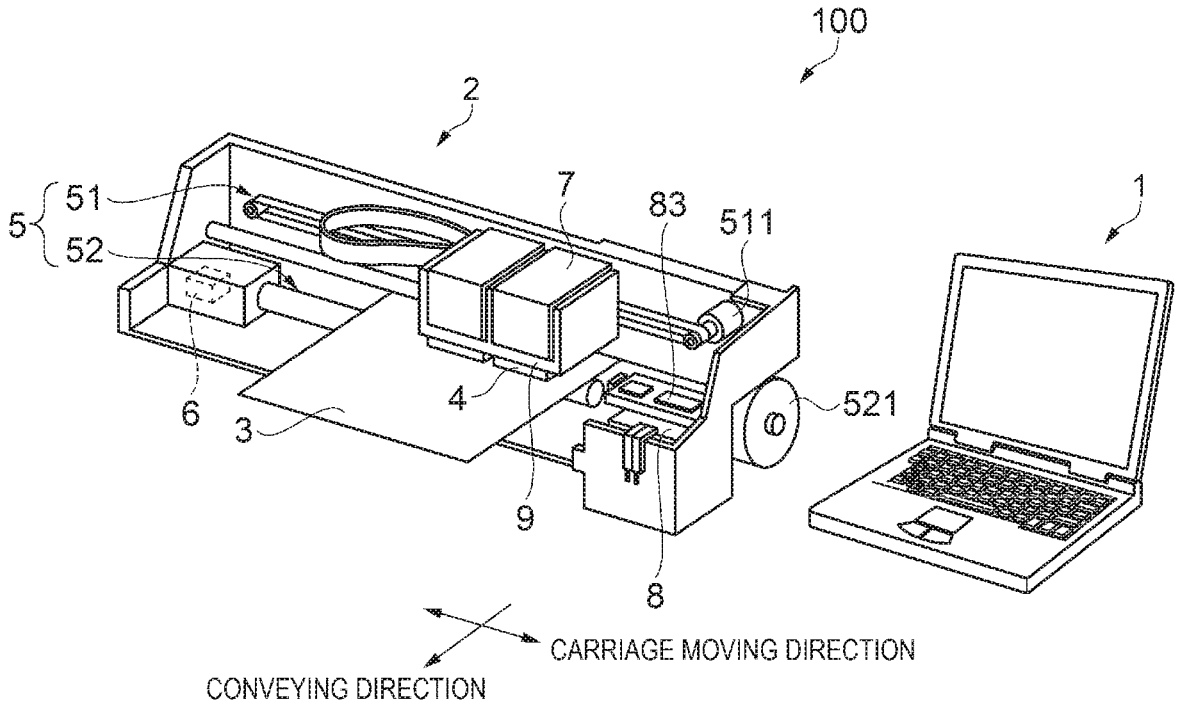
FIG. 1 is an explanatory diagram showing a schematic configuration of a droplet discharge device according to Embodiment 1.

FIG. 1 is an explanatory diagram showing a schematic configuration of a droplet discharge device according to Embodiment 1.

Schematic Configuration of Droplet Discharge Device

FIG. 1 is a diagram for explaining a schematic configuration of a computer 1 as a droplet discharge control device and a printer 2 as a droplet discharge device, wherein the droplet discharge control device and the droplet discharge device constitute a printing system 100. The printer 2 prints an image on a recording medium 3 such as a paper, cloth, or a film. The computer 1 is coupled to the printer 2 so as to be able to communicate with each other. Further, the computer 1 outputs print data corresponding to the image to the printer 2, and the printer 2 prints the image on the recording medium 3. To the computer 1, there are installed computer programs such as an application program and a printer driver.

The printer 2 has a head unit 4, a conveying mechanism 5, a control section 6, a first tank 7, and a second tank 8. The control section 6 will be described later.

The head unit 4 has a head control section 40 and a droplet discharge head 41. The droplet discharge head 41 is disposed on a surface opposed to the recording medium 3 of a carriage 9, and discharges a liquid to the recording medium 3. It is sufficient for the liquid to be a material in a state in which a substance is in the liquid phase, and a material in a liquid state such as sol or gel is also included in the liquid. Further, the liquid includes not only the liquid as one state of the substance, but also those having particles of a functional material constituted by solid substances such as pigments or metal particles dissolved, dispersed, or mixed in a solvent. There can be cited, for example, ink, liquid crystal emulsion, and a metal paste. Further, the head control section 40 is disposed inside the carriage 9, and is electrically coupled to the control section 6. It should be noted that the head control section 40 will be described later.

The conveying mechanism 5 has a carriage moving mechanism 51 and a recording medium conveying mechanism 52. The carriage moving mechanism 51 drives a motor 511 to move the carriage 9 provided with the head unit 4 in a carriage moving direction. By the carriage 9 reciprocating in the carriage moving direction and the droplet discharge head 41 discharging the liquid based on the print data, the printer 2 prints the image on the recording medium 3. The recording medium conveying mechanism 52 conveys the recording medium 3 in a conveying direction with a motor 521. The conveying direction is a direction crossing the carriage moving direction.

The first tank 7 houses the liquid to be supplied to the droplet discharge head 41 through an inflow channel 71. The first tank 7 has a first pump 73. The first pump 73 pressurizes the inside of the first tank 7 to thereby pressurize the liquid flowing through the inflow channel 71. The liquid supplied to the droplet discharge head 41 is discharged to the recording medium 3 by driving an actuator 411 inside the droplet discharge head 41 (see FIG. 2).

The second tank 8 houses the liquid which is not discharged from the droplet discharge head 41 to the recording medium 3 through an exhaust channel 81. The second tank 8 has a second pump 82. The second pump 82 reduces the pressure in the second tank 8 to thereby suction the liquid from the droplet discharge head 41 through the exhaust channel 81. It should be noted that it is also possible to omit either one of the first pump 73 and the second pump 82 (see FIG. 2).

The exhaust channel 81 in Embodiment 1 has a cap 83 having contact with the droplet discharge head 41. The second pump 82 reduces the pressure in the cap 83 via the second tank 8 to suction the liquid having increased in viscosity from the droplet discharge head 41. Thus, it is possible for the droplet discharge head 41 to prevent a precipitating component in the liquid from accumulating.

Block Diagram of Droplet Discharge Device

Figure 2:
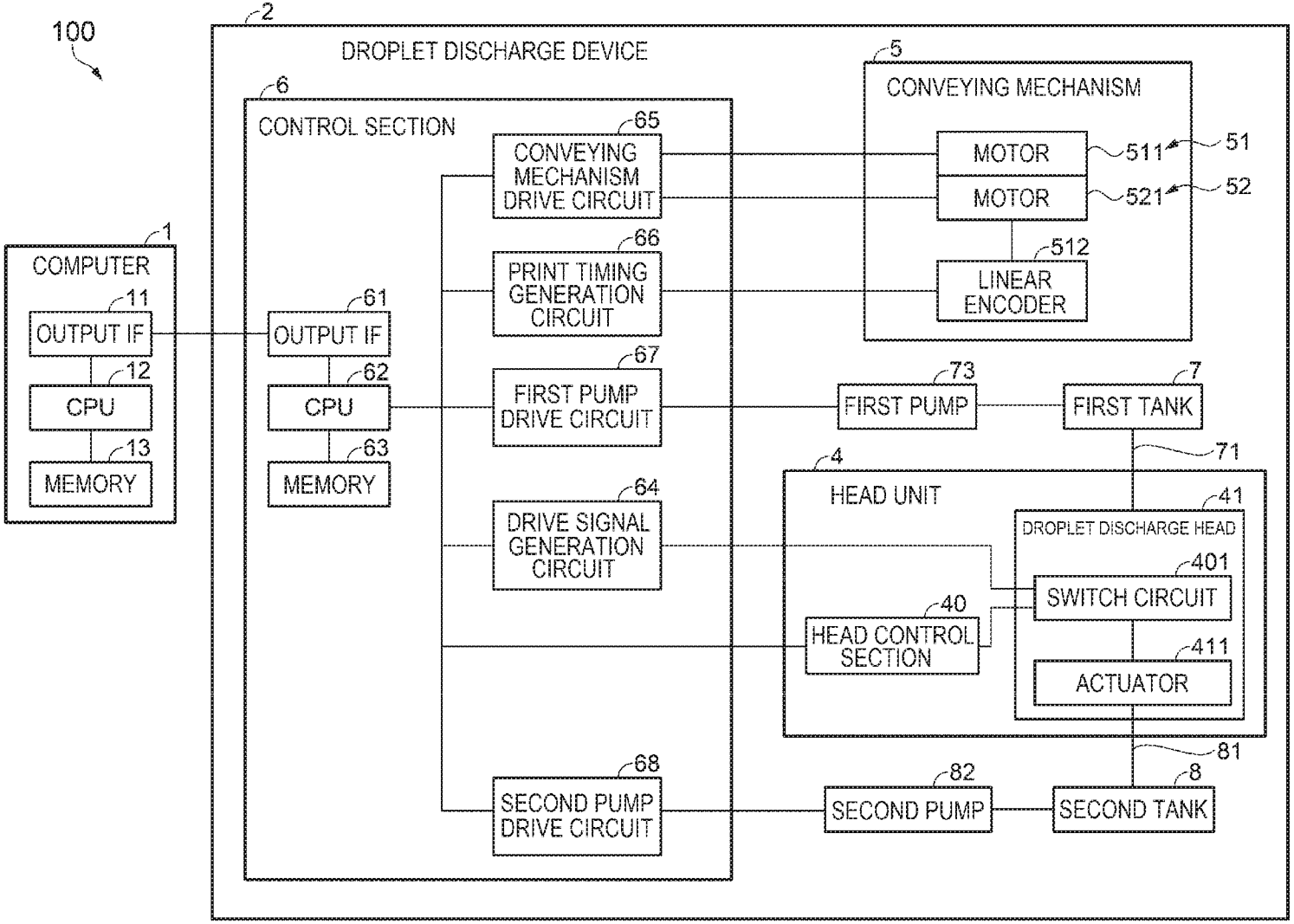
FIG. 2 is a block diagram for explaining a schematic configuration of a computer and a printer according to Embodiment 1.

FIG. 2 is a block diagram for explaining a schematic configuration of the computer 1 and the printer 2. Firstly, the configuration of the computer will briefly be described. The computer 1 has an output interface 11, a CPU 12, and a memory 13.

The output interface 11 performs delivery and receipt of data with the printer 2. The CPU 12 is an arithmetic processing device for performing overall control of the computer 1. The memory 13 is constituted by a RAM, an EEPROM, a ROM, a magnetic disk drive, and so on, and stores a computer program used by the CPU 12. As the computer program stored in the memory 13, there are cited an application program, a printer driver, and so on. Then, the CPU 12 performs a variety of types of control in accordance with the computer program.

The printer driver is a program for converting image data into print data, or the like. The print data is output to the printer 2. The print data is data in a format which can be interpreted by the printer 2, and includes a variety of types of command data and pixel data. The command data is data for instructing the printer 2 to perform a specific operation. As the command data, there are cited, for example, command data for instructing paper feed, command data representing conveying amount, and command data for instructing paper ejection. Further, pixel data is data related to pixels of the image to be printed.

Here, the pixel is a unit element for constituting the image, and by the pixels being arranged two-dimensionally, the image is constituted. The pixel data in the print data is data (e.g., grayscale values) related to dots formed on the recording medium 3.

Then, the configuration of the control section 6 located inside the printer 2 will briefly be described. The control section 6 has an input interface 61 (an input IF), a CPU 62, a memory 63, a drive signal generation circuit 64, a conveying mechanism drive circuit 65, a print timing generation circuit 66, a first pump drive circuit 67, and a second pump drive circuit 68. The input interface 61 performs delivery and receipt of data with the computer 1 as an external device. The CPU 62 is an arithmetic processing device for performing overall control of the printer 2. The memory 63 is constituted by a RAM, an EEPROM, a ROM, a magnetic disk device, and so on, and stores a computer program used by the CPU 62. Further, the CPU 62 controls each of the circuits in accordance with the computer programs stored in the memory 63.

The computer programs are a drive signal generation program, a conveying mechanism drive program, a print timing generation program, a first pump drive program, a second pump drive program, and so on.

When a clock signal is input, the drive signal generation circuit 64 generates the drive signal. The drive signal generation circuit 64 periodically generates the two or more types of drive signals, and then outputs the drive signals to a switch circuit 401.

The conveying mechanism drive circuit 65 controls the conveying amount of the conveying mechanism 5 via the motors 511, 521 and so on. For example, the conveying mechanism drive circuit 65 rotates the motor 511 of the carriage moving mechanism 51 to convey the carriage 9 in the carriage moving direction. On this occasion, a linear encoder 512 as an adjunct to the motor 511 calculates the conveying amount of the carriage 9 from a rotation amount of the motor 511, and then outputs the conveying amount to the print timing generation circuit 66. The print timing generation circuit 66 generates a clock signal based on the conveying amount, and then outputs the clock signal to the head control section 40 and the conveying mechanism drive circuit 65.

The first pump drive circuit 67 drives the first pump 73 to control the pressure in the first tank 7. Similarly, the second pump drive circuit 68 drives the second pump 82 to control the pressure in the second tank 8. The second pump 82 reduces the pressure in the second tank 8 when cleaning the droplet discharge head 41 to suction the ink having increased in viscosity from the droplet discharge head 41.

Schematic Configuration of Head

Figure 3:
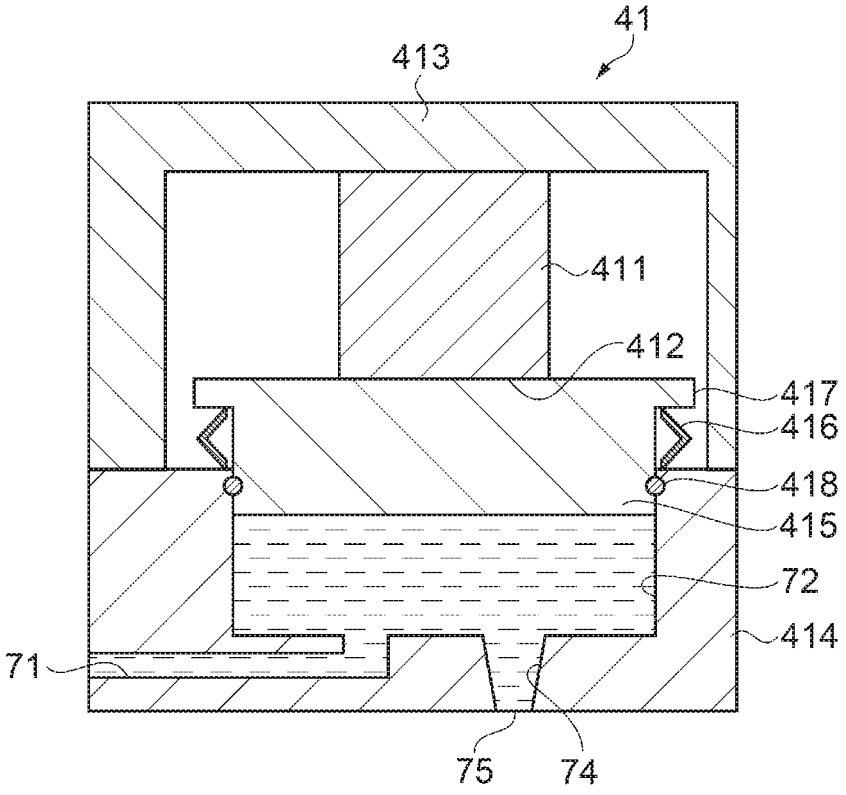
FIG. 3 is a diagram for explaining a schematic configuration of a droplet discharge head according to Embodiment 1.

FIG. 3 is a diagram for explaining a schematic configuration of the droplet discharge head 41 according to Embodiment 1. The droplet discharge head 41 has a nozzle 74, a liquid chamber 72, the inflow channel 71, a vibrating plate 415, the actuator 411, an elastic body 416, and a seal member 418.

The liquid chamber 72 is a space formed by providing a recessed part to a flow channel forming substrate 414, and sealing an opening of the recessed part with the vibrating plate 415. The liquid chamber 72 is communicated with the inflow channel 71 for supplying the liquid chamber 72 with the liquid, and the nozzle 74 for discharging the liquid to the outside.

The vibrating plate 415 is a piston which constitutes a part of wall surfaces of the liquid chamber 72, and can be displaced in a first direction and a second direction opposite to the first direction. Here, the first direction denotes a direction in which the vibrating plate 415 is displaced so as to decrease the capacity of the liquid chamber 72, and the second direction denotes a direction in which the vibrating plate 415 is displaced so as to increase the capacity of the liquid chamber 72. The seal member 418 is disposed in a gap between the vibrating plate 415 and the flow channel forming substrate 414. Thus, it is possible to prevent the liquid from being leaked from the gap between the vibrating plate 415 and the flow channel forming substrate 414.

The actuator 411 is opposed to the vibrating plate 415 in a tip part 412, and is fixed to a fixation plate 413 in a back-end part. The fixation plate 413 is fixed to the flow channel forming substrate 414. The actuator 411 is electrically coupled to the head control section 40, and is driven based on the drive signal from the switch circuit 401. In more detail, the actuator 411 is configured so as to be able to extend and contract, and touches or is separated from the vibrating plate 415. On this occasion, since the back-end part of the actuator 411 is fixed to the fixation plate 413, the position of the tip part 412 of the actuator 411 is displaced. In the state in which the actuator 411 and the vibrating plate 415 have contact with each other, by the actuator 411 extending, the tip part 412 of the actuator 411 pushes the vibrating plate 415 to thereby displace the vibrating plate 415 in the first direction. Further, by the actuator 411 contracting, the tip part 412 of the actuator 411 is displaced in a direction of getting away from the vibrating plate 415 to thereby displace the vibrating plate 415 in the second direction. In Embodiment 1, the actuator 411 is formed of a piezoelectric element (a piezo element) extending or contracting in accordance with the voltage applied.

By the actuator 411 displacing the vibrating plate 415 in the first direction, the elastic body 416 applies the force in the second direction to the vibrating plate 415. In the Embodiment 1, the vibrating plate 415 has a projecting part 417 in a direction perpendicular to the first direction, and a plate spring as the elastic body 416 is disposed between the projecting part 417 of the vibrating plate 415 and the flow channel forming substrate 414.

Description of Head Control Section 40

Figure 4:
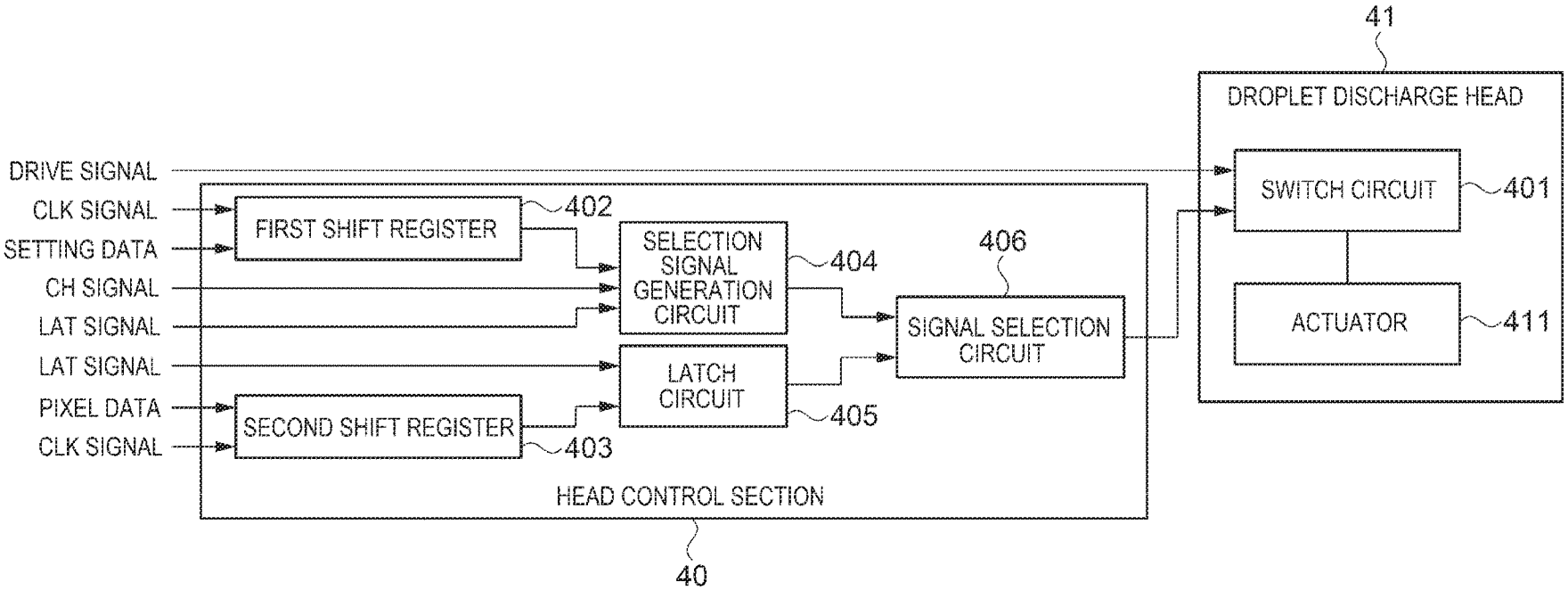
FIG. 4 is a block diagram for explaining a schematic configuration of a head control section related to Embodiment 1.

FIG. 4 is a block diagram for explaining a schematic configuration of the head control section 40 related to Embodiment 1. The head control section 40 has a first shift register 402, a second shift register 403, a selection signal generation circuit 404, a latch circuit 405, and a signal selection circuit 406.

A clock signal (CLK signal), a latch signal (LAT signal), a change signal (CH signal), and a setting signal are input from the control section 6 to the head control section 40. It should be noted that the setting signal includes the pixel data and setting data.

When the setting signal is input to the head control section 40 in sync with the clock signal, the setting data is set to the first shift register 402, and the pixel data is set to the second shift register 403. Then, in accordance with the pulse of the latch signal, the setting data is latched by the selection signal generation circuit 404, and the pixel data is latched by the latch circuit 405.

The selection signal generation circuit 404 generates a plurality of selection signals based on the setting data and the change signal. The signal selection circuit 406 selects one from the plurality of selection signals input from the selection signal generation circuit 404 in accordance with the pixel data latched by the latch circuit 405. The selection signal thus selected is output from the signal selection circuit 406 as the switch signal.

The drive signal and the switch signal are input to the switch circuit 401. When the switch signal is in an H level, the switch circuit 401 is set to an ON state, and thus, the drive signal is applied to the actuator 411. When the switch signal is in an L level, the switch circuit 401 is set to an OFF state, and thus, the drive signal is not applied to the actuator 411.

Droplet Discharge Control

Figure 5:
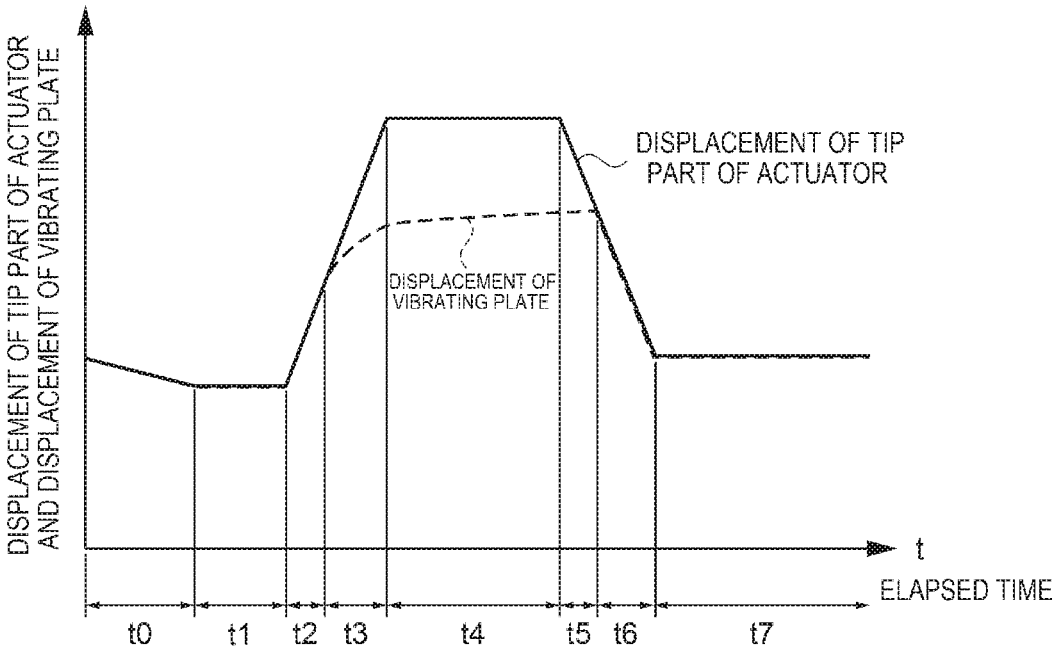
FIG. 5 is an explanatory diagram showing a displacement of a tip part of an actuator and a vibrating plate based on a drive signal related to Embodiment 1.

FIG. 5 is an explanatory diagram showing the displacement of the tip part 412 of the actuator 411 and the displacement of the vibrating plate 415 based on the drive signal. Specifically, FIG. 5 shows an example of a timing chart (solid line) of the actuator 411 executed based on the drive signal input from the switch circuit 401, and a timing chart (dotted line) of the vibrating plate 415 displaced due to the drive of the actuator 411. In FIG. 5, the horizontal axis represents elapsed time, and the vertical axis represents the displacement of the tip part 412 of the actuator 411, and the displacement of the vibrating plate 415. It should be noted that in the displacement of the tip part 412 of the actuator 411 and the displacement of the vibrating plate 415, the second direction is defined as positive. The timing charts represent a sequence of droplet discharge control for discharging the liquid from the nozzle 74 as a droplet.

FIG. 6A through FIG. 6D are diagrams for explaining the action of the droplet discharge head 41 in accordance with the droplet discharge control.

FIG. 7A through FIG. 7D are diagrams for explaining a temporal change of a meniscus in the nozzle 74 in accordance with the droplet discharge control. The cross-sectional surface is a surface including the central axis C of the nozzle 74.

As shown in FIG. 5, the control section 6 performs eight processes in respective periods t0 through t7 during the sequence of discharge control. The period t0 corresponds to an initial state forming process for the control section 6 to displace the tip part 412 of the actuator 411 from an intermediate potential to an initial state. The period t1 corresponds to an initial state holding process for the control section 6 to hold the tip part 412 of the actuator 411 in the initial state. The period t2 corresponds to a pull-in process for the control section 6 to displace the tip part 412 of the actuator 411 toward the second direction to pull in the meniscus toward the liquid chamber 72. The period t3 corresponds to a separation process for the control section 6 to further displace the tip part 412 of the actuator 411 toward the second direction to separate the tip part 412 of the actuator 411 and the vibrating plate 415 from each other. The period t4 corresponds to a standby process for the control section 6 to hold the displacement of the tip part 412 of the actuator 411. The period t5 corresponds to a collision process for the control section 6 to displace the tip part 412 of the actuator 411 toward the first direction to make the tip part 412 of the actuator 411 collides with the vibrating plate 415. The period t6 corresponds to a push process for the control section 6 to further displace the tip part 412 of the actuator 411 toward the first direction to set the tip part 412 to the intermediate potential. It should be noted that the period t5 and the period t6 correspond to a series of actions included in the discharge process for discharging the liquid from the nozzle 74. The period t7 corresponds to a refill process for the control section 6 to hold the tip part 412 of the actuator 411 at the intermediate potential to supply the liquid to the nozzle 74 from the inflow channel 71 via the liquid chamber 72.

Figure 7A:
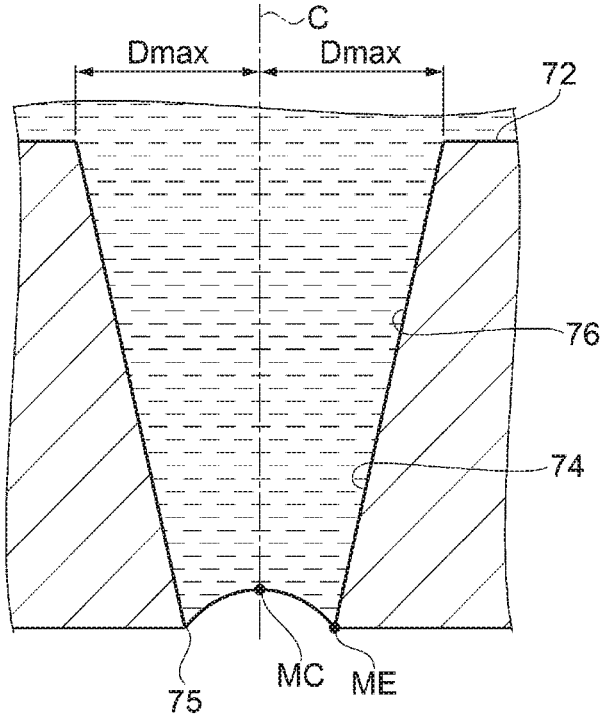
FIG. 7A is a cross-sectional view schematically showing a meniscus in the initial state forming process related to Embodiment 1.

In the initial state forming process in the period t0, the liquid in the nozzle 74 before starting the discharge control is kept in pressure no higher than the meniscus withstanding pressure. At that moment, as shown in FIG. 7A, a boundary ME between a nozzle wall surface 76 and the meniscus is located at an opening 75 of the nozzle 74, and a meniscus MC on the central axis C of the nozzle 74 is located on the liquid chamber 72 side in the nozzle 74 due to the surface tension. This state is defined as a stable state.

Figure 6A:
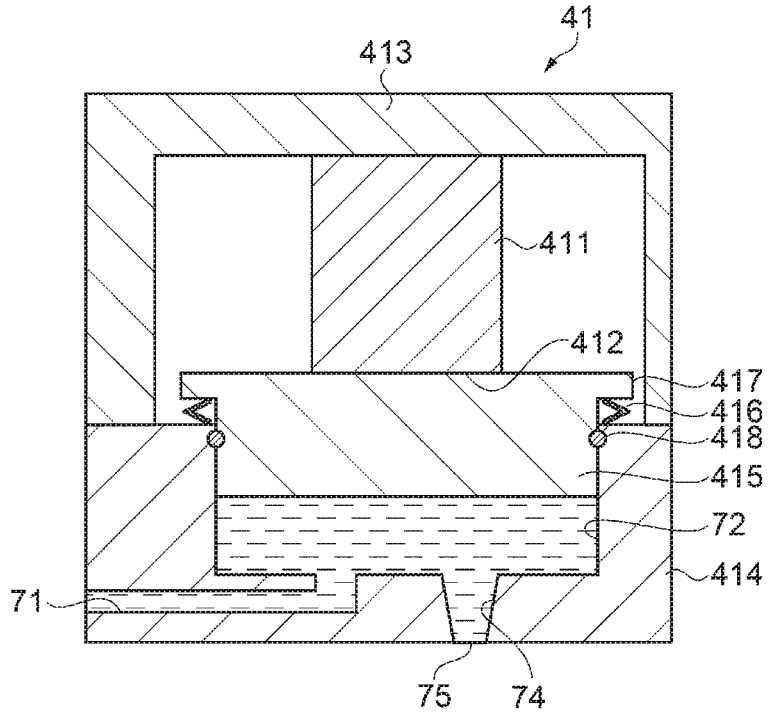
FIG. 6A is a diagram for explaining an initial state forming process of the droplet discharge head according to Embodiment 1.

In the period t0, the tip part 412 of the actuator 411 has contact with the vibrating plate 415 to push the vibrating plate 415. Therefore, the elastic body 416 is contracted toward the first direction to apply the force in the second direction to the vibrating plate 415 (FIG. 6A). This state is defined as the initial state. By forming the initial state, even in the droplet discharge head 41 in which the actuator 411 and the vibrating plate 415 are not bonded to each other, the pull-in process described later can be performed. At that moment, the tip part 412 of the actuator 411 and the vibrating plate 415 are displaced so that the pressure in the liquid chamber 72 is kept no higher than the meniscus withstanding pressure. In the initial state holding process in the period t1, the displacement of the tip part 412 of the actuator 411 and the displacement of the vibrating plate 415 are kept constant.

Figure 7B:
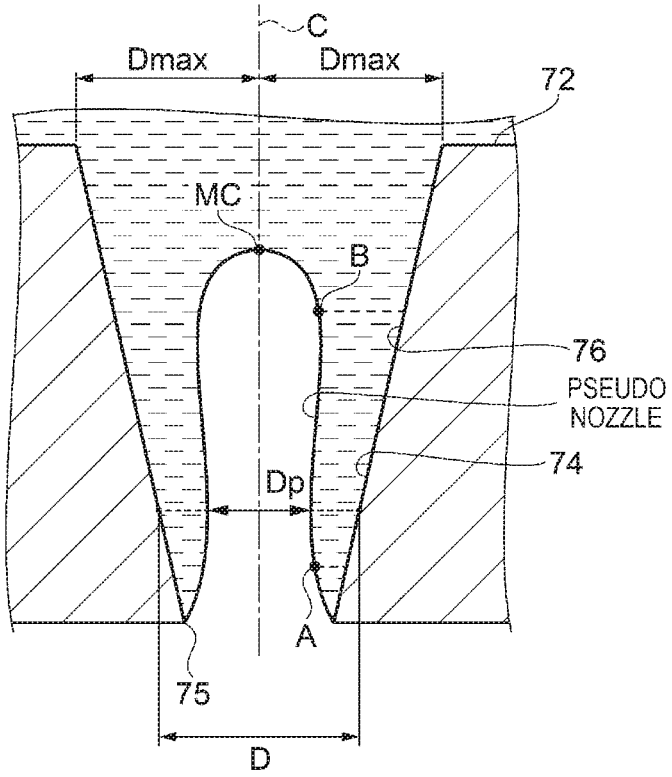
FIG. 7B is a cross-sectional view schematically showing a meniscus in a pull-in process related to Embodiment 1.

In the pull-in process in the period t2, since the force in the second direction is applied by the elastic body 416 to the vibrating plate 415, the vibrating plate 415 is displaced toward the second direction in the state of keeping the contact with the tip part 412 of the actuator 411 in accordance with the displacement in the second direction of the tip part 412 of the actuator 411. Thus, the capacity of the liquid chamber 72 increases to reduce the pressure in the liquid chamber 72. In the pull-in process, the liquid at the center of the nozzle 74 is pulled in toward the liquid chamber 72, and the liquid on the nozzle wall surface 76 is retained in place keeping a predetermined thickness. This is caused by the fact that a strong frictional force acts in a region (a boundary between the nozzle wall surface 76 and the liquid) in the vicinity of the boundary surface between a solid and a liquid, and the flow velocity decreases under the influence of the viscosity. The higher the viscosity of the liquid becomes, the stronger the influence of the boundary surface on the liquid becomes. Therefore, when the liquid chamber 72 becomes in the negative pressure to generate a flow velocity in the liquid located in the nozzle 74, the liquid is retained on the nozzle wall surface 76, and the liquid at the center of the nozzle 74 small in influence of the boundary surface is pulled in to form a pseudo nozzle one size smaller in diameter than the nozzle 74 (FIG. 7B). Here, the diameter of the nozzle 74 denotes the distance between the nozzle wall surfaces 76 opposed to each other via the nozzle central axis C on a plane having the nozzle central axis C as the normal line.

As shown in FIG. 7B, a thickness tm of the liquid retained on the nozzle wall surface 76 is defined as an average thickness obtained by the following method. Firstly, the state of the liquid in the nozzle 74 is imaged by a stroboscope laterally to the nozzle 74, and then a curved segment fulfilling any one of the following conditions (i) through (iii) is obtained from the curve represented by the meniscus in the two-dimensional image thus obtained. (i) A curvature center of the meniscus is located on the nozzle wall surface 76 side with respect to the meniscus. (ii) A curvature radius of the meniscus is infinite. It should be noted that the expression that the curvature radius of the meniscus is infinite denotes that the curvature radius of the meniscus is double-digit or more larger than the diameter of the opening 75 of the nozzle 74. (iii) The curvature center of the meniscus is located on the central axis C side of the nozzle 74 with respect to the meniscus, and at the same time, the curvature radius of the meniscus is larger than a maximum radius Dmax of the nozzle 74. In the curved segment obtained in such a manner, an end part on the opening 75 side of the nozzle 74 is defined as a point A, and an end part on the liquid chamber 72 side is defined as a point B. An average of a distance between the meniscus of the curved segment between the point A and the point B on the plane having the nozzle central axis C as the normal line and the nozzle wall surface 76 is defined as the thickness tm of the liquid. It should be noted that the diameter of the pseudo nozzle is defined as a diameter Dp in which the distance between the meniscuses opposed to each other via the nozzle central axis C on the plane having the nozzle central axis C as the normal line becomes the shortest in the curved segment between the point A and the point B when viewing the meniscus from the opening 75 side of the nozzle 74. The diameter Dp is defined as the diameter of the pseudo nozzle. It is preferable for the diameter Dp to be ¼ through ⅔ of the diameter of the nozzle 74 on the plane which has the nozzle central axis C as the normal line and includes the diameter Dp.

Figure 6B:
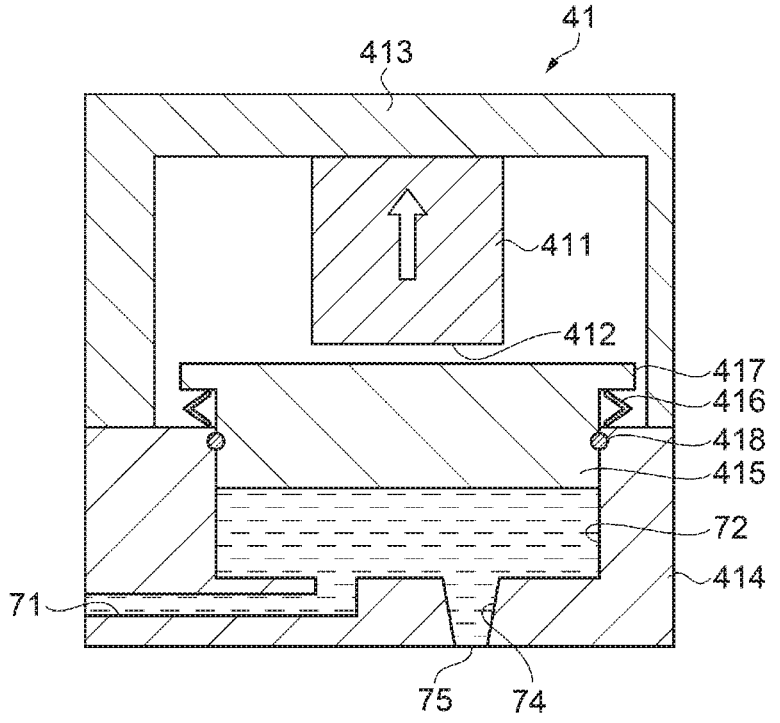
FIG. 6B is a diagram for explaining a separation process of the droplet discharge head according to Embodiment 1.

In the separation process in the period t3, the tip part 412 of the actuator 411 is separated from the vibrating plate 415 (FIG. 6B). This is caused by the fact that the force in the second direction applied by the elastic body 416 to the vibrating plate 415 is a restoring force. In accordance with the displacement of the vibrating plate 415, the elastic body 416 extends in the second direction, and the force in the second direction applied to the vibrating plate 415 decreases. Therefore, the displacement of the vibrating plate 415 per unit time in the period t3 decreases with the elapsed time. On the other hand, the displacement of the tip part 412 of the actuator 411 per unit time is constant with respect to the elapsed time in Embodiment 1. Therefore, the tip part 412 of the actuator 411 is separated from the vibrating plate 415. At that moment, the meniscus is pulled in toward the liquid chamber 72 similarly to the pull-in process (FIG. 7B).

In the standby process in the period t4, the control section 6 keeps the displacement of the tip part 412 of the actuator 411 constant, and in the period t5, the tip part 412 of the actuator 411 is displaced toward the first direction. During this period, the vibrating plate 415 is displaced toward the second direction. The meniscus is pulled in toward the liquid chamber 72 similarly to the pull-in process.

Figure 6C:
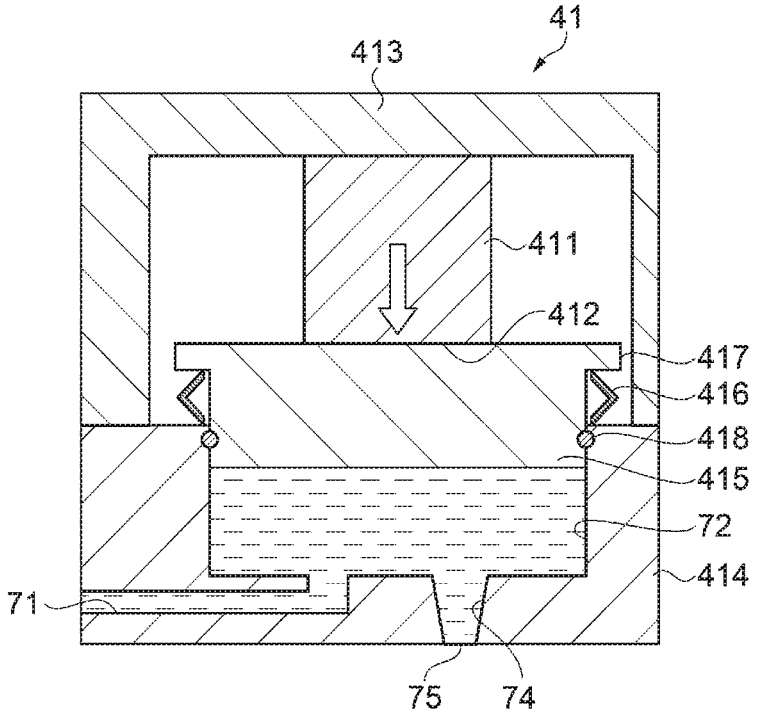
FIG. 6C is a diagram for explaining a collision process of the droplet discharge head according to Embodiment 1.
Figure 7C:
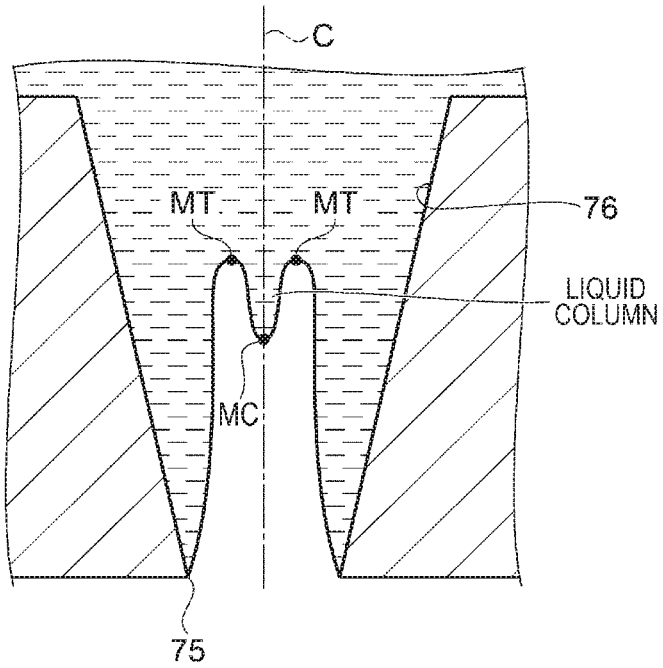
FIG. 7C is a cross-sectional view schematically showing a meniscus in the collision process related to Embodiment 1.

In the collision process in the period t5, the tip part 412 of the actuator 411 is accelerated in the first direction to collide with the vibrating plate 415 (FIG. 6C). Then, due to the impact force when the actuator 411 and the vibrating plate 415 collide with each other, a large amount of energy is instantaneously supplied to the liquid in the liquid chamber 72, and the pressure in the liquid chamber 72 rapidly rises. Since the pressure wave propagates from the liquid chamber 72 to the liquid in the nozzle 74, the meniscus MC on the central axis C of the nozzle 74 is reversed to the opening 75 side of the nozzle 74 to form a liquid column (FIG. 7C). Here, the liquid column denotes a range from the crest MC of the meniscus thus reversed to an extreme value MT where the meniscus becomes convex toward the liquid chamber 72.

Figure 6D:
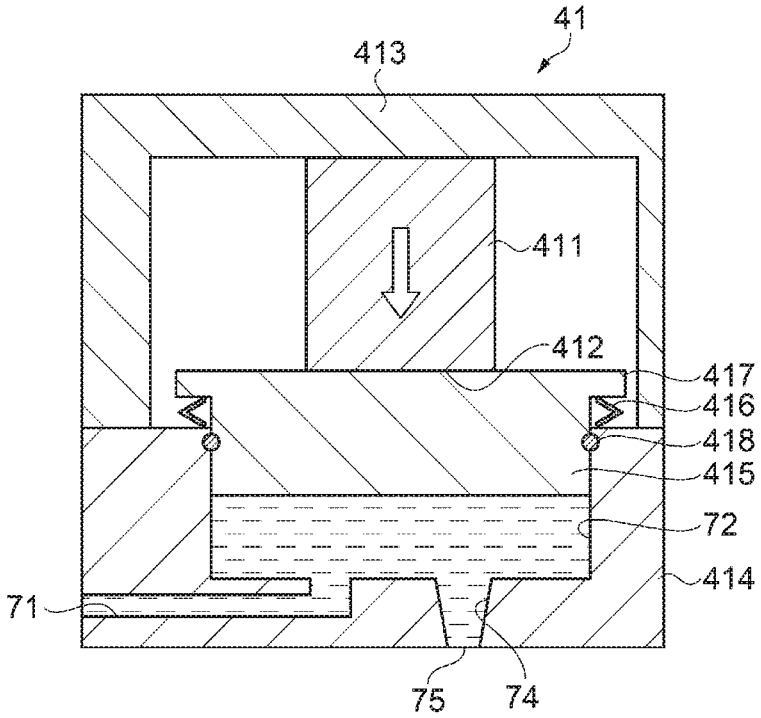
FIG. 6D is a diagram for explaining a push process of the droplet discharge head according to Embodiment 1.
Figure 7D:
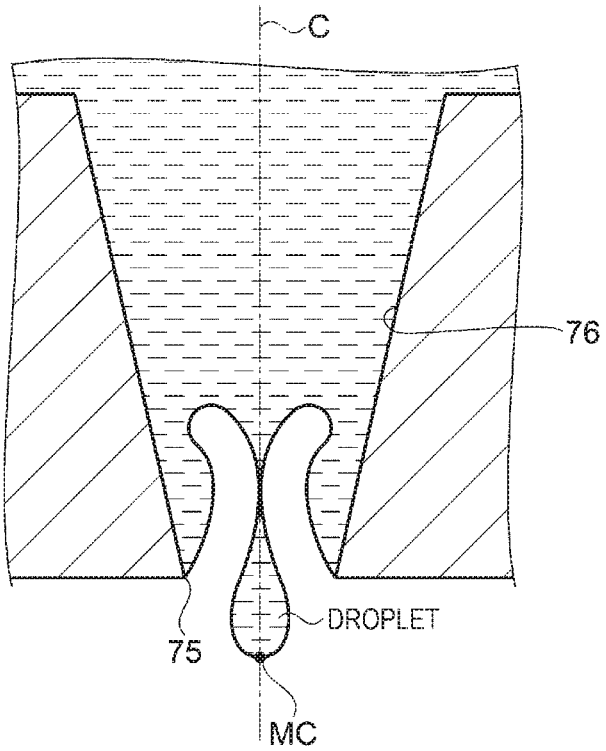
FIG. 7D is a cross-sectional view schematically showing a meniscus in the push process related to Embodiment 1.

In the push process in the period t6, after the actuator 411 and the vibrating plate 415 collide with each other, the tip part 412 of the actuator 411 has contact with the vibrating plate 415, and pushes the vibrating plate 415 in the first direction to the intermediate potential of the actuator 411 (FIG. 6D). Thus, the capacity of the liquid chamber 72 decreases to pressurize the liquid in the nozzle 74. The liquid in the nozzle 74 thus pressurized is concentrated into the liquid column to selectively pressurize only the liquid column. This is caused by the fact that the pseudo nozzle is formed at the center of the nozzle 74, and therefore, the flow channel resistance at the center of the nozzle is smaller compared to the flow channel resistance on the nozzle wall surface 76. Then, when the sum of the energy supplied to the liquid column exceeds the energy necessary for the liquid column to be separated from the meniscus, the liquid column is discharged from the opening 75 of the nozzle 74 as a droplet (FIG. 7D). In other words, when the energy for separating the liquid column from the meniscus is supplied from the actuator 411 in the collision process, it is also possible for the pressurization of the liquid in the push process to be performed for restoring the meniscus to the stable state.

In the refill process in the period t7, the displacement of the actuator 411 and the displacement of the vibrating plate 415 are kept constant. At that moment, the meniscus in the nozzle 74 is restored to the stable state due to the displacement of the tip part 412 of the actuator 411 and the supply of the liquid from the inflow channel 71.

As described hereinabove, according to the droplet discharge head 41 related to Embodiment 1, by making the actuator 411 and the vibrating plate 415 collide with each other, a large amount of energy is instantaneously supplied to the liquid in the liquid chamber 72, and it is possible to reverse the meniscus MC on the central axis C of the nozzle 74. Therefore, even when discharging the high-viscosity liquid, it is possible to prevent the pull-in amount of the meniscus in the nozzle 74 from increasing compared to the related-art discharge control method. Thus, it is possible to prevent the pressure in the liquid chamber 72 from being rapidly reduced, and it is possible to reduce the occurrence of the bubbles in the liquid chamber 72. Further, since a reactive force in the opposite direction to the direction in which the tip part is displaced is not applied to the actuator 411 in the periods t2 through t5, it is possible to make the drive speed faster compared to when the vibrating plate 415 and the actuator 411 are bonded to each other. Thus, even in the case of the high-viscosity liquid, the drive frequency can be made higher.

Embodiment 2

Schematic Configuration of Head

Figure 8:
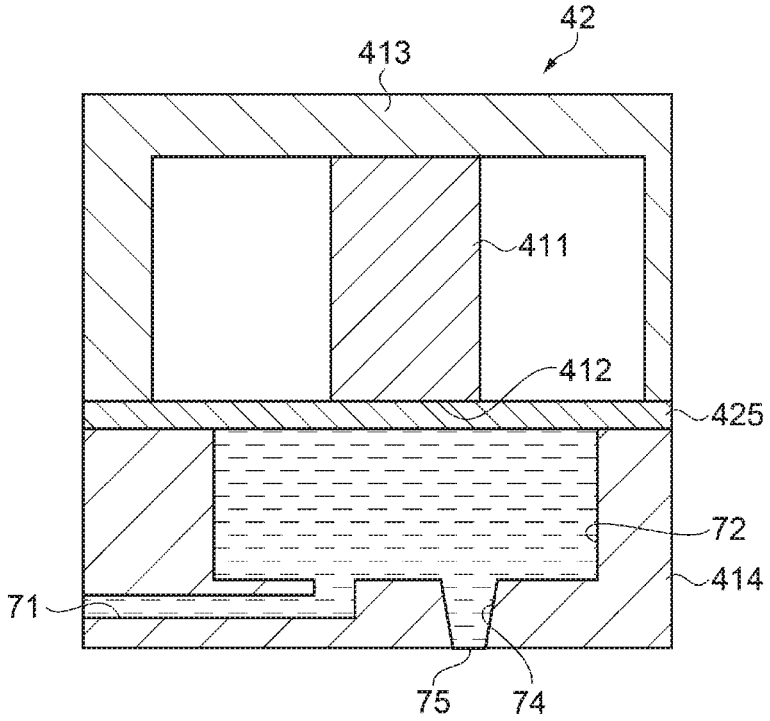
FIG. 8 is a diagram for explaining a schematic configuration of a droplet discharge head according to Embodiment 2.

FIG. 8 is a diagram for explaining a schematic configuration of a droplet discharge head 42 according to Embodiment 2. Embodiment 2 is different in the configuration of a vibrating plate 425 from Embodiment 1. Due to the difference in the configuration, the seal member 418 and the elastic body 416 do not exist in Embodiment 2. It should be noted that the same constituents as in Embodiment 1 are denoted by the same reference numerals, and the duplicated descriptions will be omitted. The vibrating plate 425 in Embodiment 2 is fixed to the flow channel forming substrate 414 to constitute a part of the wall surfaces of the liquid chamber 72. The vibrating plate 425 is formed of a flexurally deformable plate-like member (a diaphragm), and by the actuator 411 applying a force toward the first direction to the vibrating plate 425, the vibrating plate 425 flexurally deforms in the first direction to reduce the capacity of the liquid chamber 72.

Droplet Discharge Control Method

FIG. 9A through FIG. 9D are diagrams for explaining a temporal change of the droplet discharge head in accordance with the droplet discharge control according to Embodiment 2. It should be noted that the timing chart showing the sequence of droplet discharge control for discharging a droplet from the nozzle 74, and the cross-sectional view for explaining the temporal change of the meniscus in the nozzle 74 in accordance with the droplet discharge control are substantially the same as those in Embodiment 1 (see FIG. 5).

As shown in FIG. 5, the control section 6 performs the eight processes in the respective periods t0 through t7 during the sequence of discharge control. The period t0 corresponds to the initial state forming process for the control section 6 to displace the tip part 412 of the actuator 411 from the intermediate potential to the initial state. The period t1 corresponds to the initial state holding process for the control section 6 to hold the tip part 412 of the actuator 411 in the initial state. The period t2 corresponds to the pull-in process for the control section 6 to displace the tip part 412 of the actuator 411 toward the second direction to pull in the meniscus toward the liquid chamber 72. The period t3 corresponds to the separation process for the control section 6 to further displace the tip part 412 of the actuator 411 toward the second direction to separate the tip part 412 of the actuator 411 and the vibrating plate 425 from each other. The period t4 corresponds to the standby process for the control section 6 to hold the displacement of the tip part 412 of the actuator 411. The period t5 corresponds to the collision process for the control section 6 to displace the tip part 412 of the actuator 411 toward the first direction to make the tip part 412 of the actuator 411 collides with the vibrating plate 425. The period t6 corresponds to the push process for the control section 6 to further displace the tip part 412 of the actuator 411 toward the first direction to set the tip part 412 to the intermediate potential. The period t7 corresponds to the refill process for the control section 6 to hold the tip part 412 of the actuator 411 at the intermediate potential to supply the liquid from the inflow channel 71. It should be noted that the displacement of the vibrating plate 425 denotes the maximum value of the displacement in the second direction of the vibrating plate 425 having flexurally deformed.

Figure 9A:
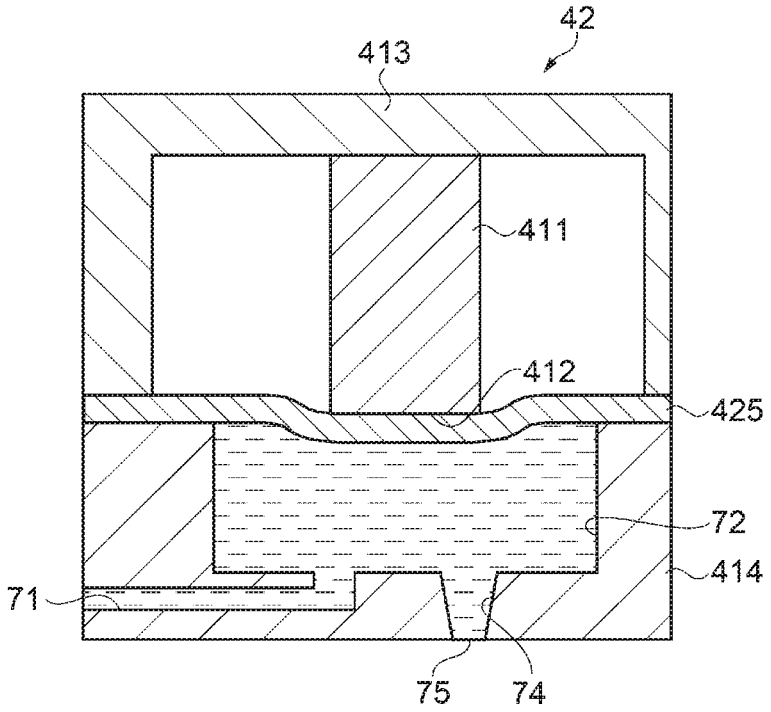
FIG. 9A is a diagram for explaining an initial state forming process of the droplet discharge head according to Embodiment 2.

In the period t0, the tip part 412 of the actuator 411 has contact with the vibrating plate 425 to push the vibrating plate 425. Therefore, the vibrating plate 425 flexurally deforms toward the first direction, and has a restoring force toward the second direction (FIG. 9A). This state is defined as the initial state. By forming the initial state, even in the droplet discharge head 42 in which the actuator 411 and the vibrating plate 425 are not bonded to each other, the pull-in process described later can be performed. At that moment, the tip part 412 of the actuator 411 and the vibrating plate 425 are displaced so that the pressure in the liquid chamber 72 is kept no higher than the meniscus withstanding pressure. In the period t1, the displacement of the actuator 411 and the displacement of the vibrating plate 425 are kept constant.

In the period t2, the vibrating plate 425 has the restoring force in the second direction, and is therefore displaced toward the second direction in the state of keeping the contact with the tip part 412 of the actuator 411 in accordance with the displacement in the second direction of the tip part 412 of the actuator 411. Thus, the capacity of the liquid chamber 72 increases to reduce the pressure in the liquid chamber 72. At that moment, the meniscus MC on the central axis C of the nozzle 74 is pulled in toward the liquid chamber 72 compared to the initial state, and the liquid on the nozzle wall surface 76 is retained in place keeping a predetermined thickness.

Figure 9B:
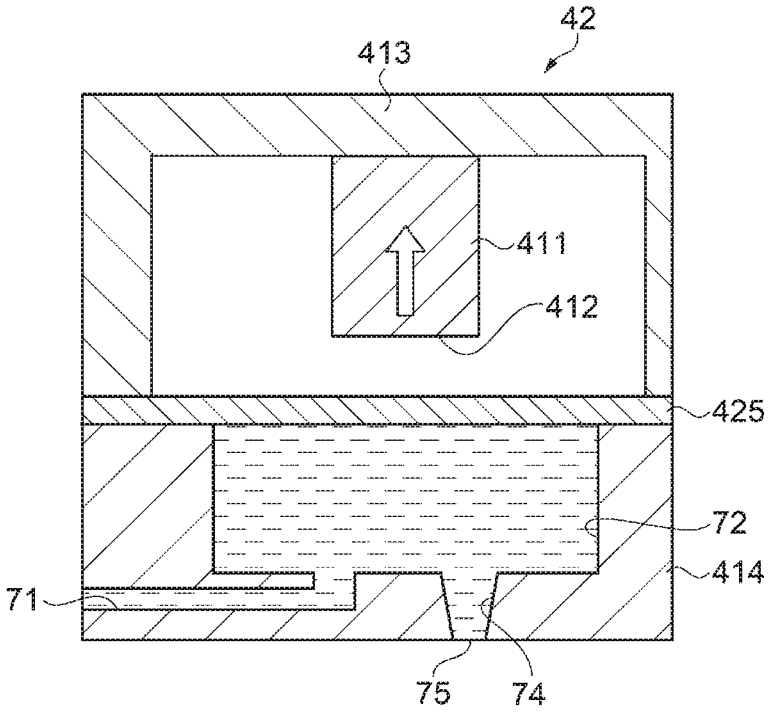
FIG. 9B is a diagram for explaining a separation process of the droplet discharge head according to Embodiment 2.

In the period t3, the tip part 412 of the actuator 411 is separated from the vibrating plate 425 (FIG. 9B). This is caused by the fact that the vibrating plate 425 has the restoring force toward the second direction. With the displacement in the second direction of the vibrating plate 425, the restoring force of the vibrating plate 425 decreases. Subsequently, the vibrating plate 425 flexurally deforms toward the second direction due to the recoil of the flexural deformation in the first direction via the state with 0 flexure. At this moment, the vibrating plate 425 has the restoring force toward the first direction. Therefore, the displacement of the vibrating plate 425 per unit time in the period t3 decreases with the elapsed time. On the other hand, the displacement of the tip part 412 of the actuator 411 per unit time is constant with respect to the elapsed time in Embodiment 2. Therefore, the tip part 412 of the actuator 411 is separated from the vibrating plate 425. At that moment, the meniscus is pulled in toward the liquid chamber 72 similarly to the pull-in process (FIG. 7B).

In the period t4, the control section 6 keeps the displacement of the tip part 412 of the actuator 411 constant, and in the period t5, the tip part 412 of the actuator 411 is displaced toward the first direction. During this period, the vibrating plate 425 is displaced toward the second direction. The meniscus is pulled in toward the liquid chamber 72 similarly to the pull-in process.

Figure 9C:
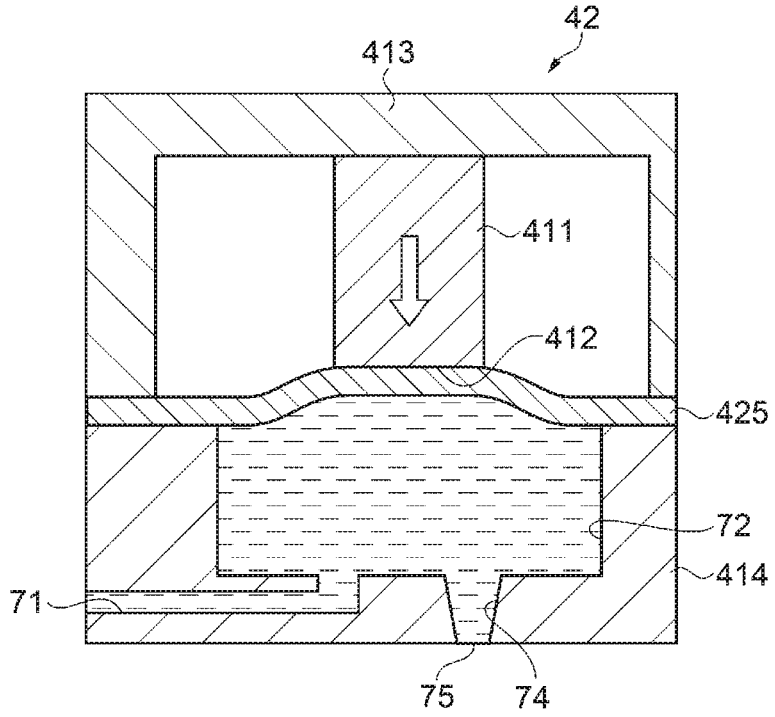
FIG. 9C is a diagram for explaining a collision process of the droplet discharge head according to Embodiment 2.

In the period t5, the tip part 412 of the actuator 411 is accelerated in the first direction to collide with the vibrating plate 425 (FIG. 9C). Then, due to the impact force when the actuator 411 and the vibrating plate 425 collide with each other, a large amount of energy is instantaneously supplied to the liquid in the liquid chamber 72, and the pressure in the liquid chamber 72 rapidly rises. Since the pressure wave propagates from the liquid chamber 72 to the liquid in the nozzle 74, the meniscus MC on the central axis C of the nozzle 74 is reversed to the opening 75 side of the nozzle 74 to form the liquid column (FIG. 7C).

Figure 9D:
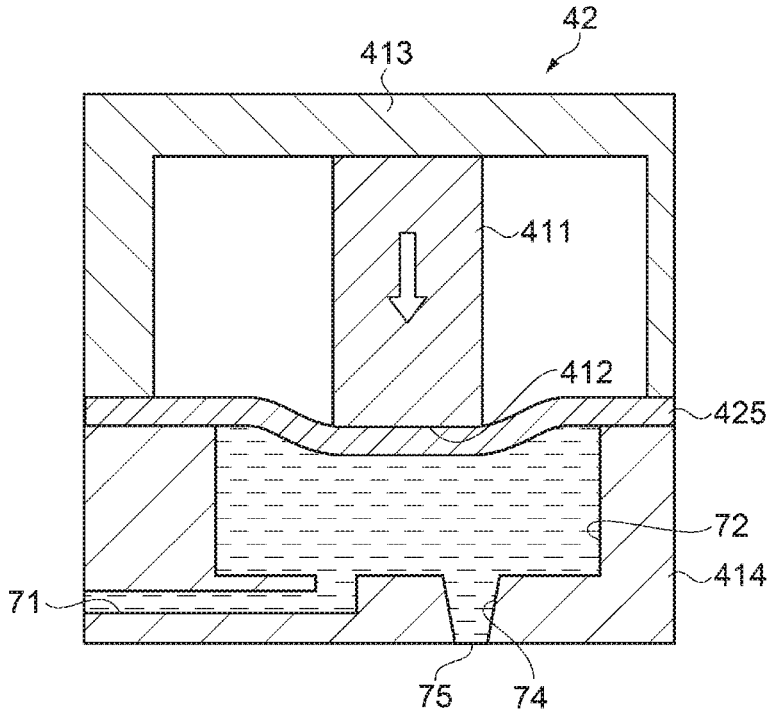
FIG. 9D is a diagram for explaining a push process of the droplet discharge head according to Embodiment 2.

In the period t6, after the actuator 411 and the vibrating plate 425 collide with each other, the tip part 412 of the actuator 411 has contact with the vibrating plate 425, and pushes the vibrating plate 425 in the first direction to the intermediate potential (FIG. 9D). Thus, the capacity of the liquid chamber 72 decreases to pressurize the liquid in the nozzle 74. The liquid in the nozzle 74 thus pressurized is concentrated into the liquid column to selectively pressurize only the liquid column. This is caused by the fact that the pseudo nozzle is formed at the center of the nozzle, and therefore, the flow channel resistance at the center of the nozzle is smaller compared to the flow channel resistance on the nozzle wall surface 76. Then, when the sum of the energy supplied to the liquid column exceeds the energy necessary for the liquid column to be separated from the meniscus, the liquid column is discharged from the opening 75 of the nozzle 74 as a droplet (FIG. 7D).

In the period t7, the displacement of the tip part 412 of the actuator 411 and the displacement of the vibrating plate 425 are kept constant. At that moment, the meniscus in the nozzle 74 is restored to the state shown in FIG. 7A due to the displacement of the tip part 412 of the actuator 411 and the supply from the inflow channel 71.

As described hereinabove, according to the droplet discharge head 42 related to Embodiment 2, by making the actuator 411 and the vibrating plate 425 collide with each other, a large amount of energy is instantaneously supplied to the liquid in the liquid chamber 72, and it is possible to reverse the meniscus MC on the central axis C of the nozzle 74. Therefore, it is possible to prevent the pull-in amount of the meniscus in the nozzle 74 from increasing compared to the related-art discharge control method. Thus, it is possible to prevent the pressure in the liquid chamber 72 from being rapidly reduced, and it is possible to reduce the occurrence of the bubbles in the liquid chamber 72.

It should be noted that the present disclosure is not limited to the embodiments described above, but a variety of modifications or improvements can be provided to the embodiments described above. Some modified examples will be described below.

Modified Example 1

In Embodiment 1, the description is presented assuming that the elastic body 416 is a plate spring as shown in FIG. 3, but it is also possible for the elastic body 416 to be an O-ring formed of silicone or rubber. In this case, it is preferable for the contact area between the projecting part 417 of the vibrating plate 415 and the elastic body 416 to surround the opening of the recessed part of the flow channel forming substrate 414 when viewed from the actuator 411 side. Thus, the elastic body 416 plays the role of the seal member 418, the seal member 418 becomes unnecessary, and thus, it is possible to simplify the configuration of the droplet discharge head 41.

Modified Example 2

Figure 10A:
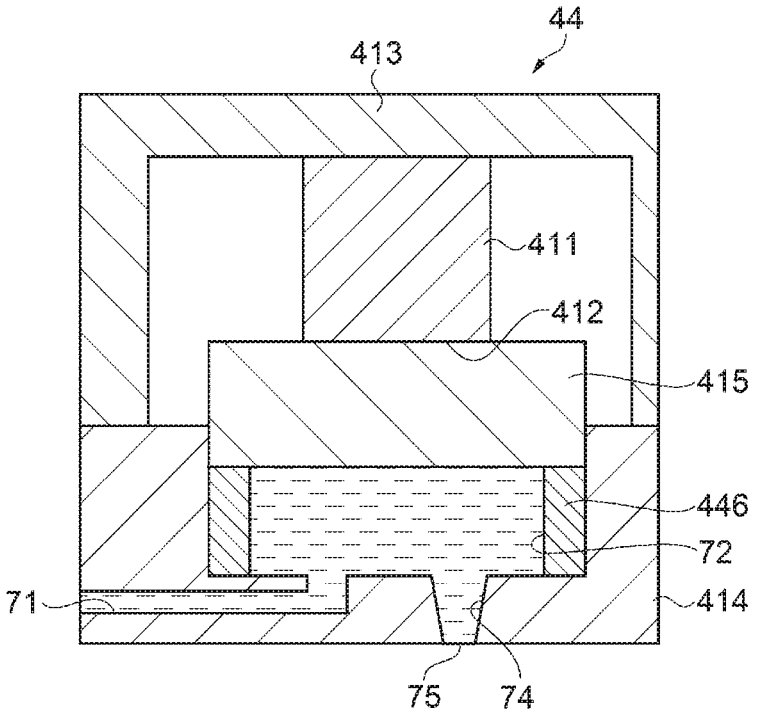
FIG. 10A is a diagram for explaining a schematic configuration of a droplet discharge head according to Modified Example 2.
Figure 10B:
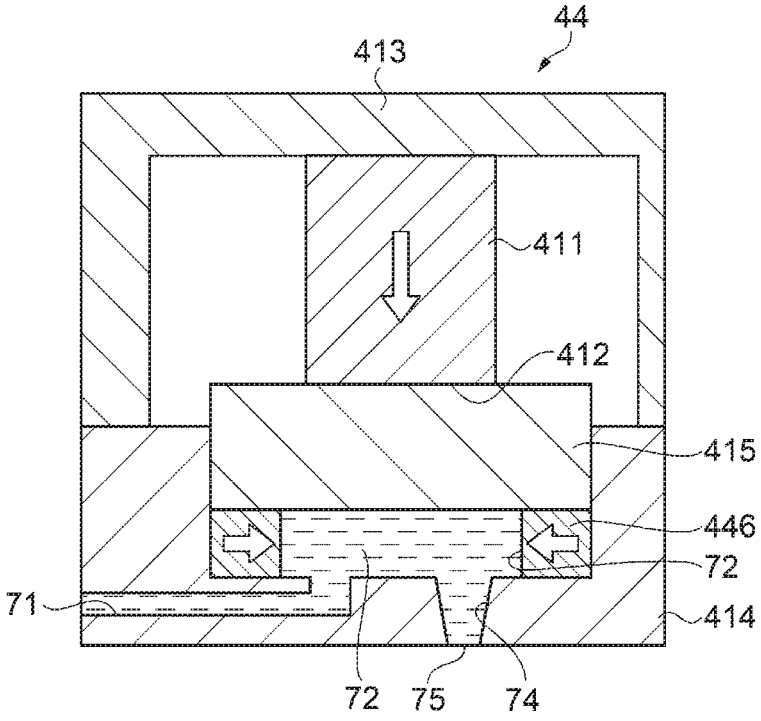
FIG. 10B is a diagram for explaining a schematic configuration of the droplet discharge head according to Modified Example 2.

FIG. 10A and FIG. 10B are diagrams for explaining a schematic configuration of a droplet discharge head 44 according to Modified Example 2. It should be noted that FIG. 10B shows the state in which the control section 6 displaces the tip part 412 of the actuator 411 from the state shown in FIG. 10A toward the first direction.

In Modified Example 1, the elastic body 416 (the O-ring) for preventing the liquid leakage from the gap between the vibrating plate 415 and the flow channel forming substrate 414 is disposed between the projecting part 417 of the vibrating plate 415 and the flow channel forming substrate 414. In contrast, it is also possible for the elastic body 446 in the Modified Example 2 to be disposed inside the recessed part of the flow channel forming substrate 414 to constitute a part of the wall surfaces of the liquid chamber 72. As shown in FIG. 10B, when the control section 6 displaces the tip part 412 of the actuator 411 toward the first direction, the elastic body 446 is compressed in the first direction, and is displaced inward in the liquid chamber 72.

Thus, when driving the actuator 411 to reduce the pressure in the liquid chamber 72, it is possible for the liquid chamber 72 not only to increase the capacity in the second direction, but also to increase the capacity in a third direction perpendicular to the second direction. Therefore, it is possible to increase a capacity variation without changing the capacity of the liquid chamber 72. Thus, it becomes possible to achieve reduction in size and an increase in density of the droplet discharge head. Further, since it is possible to reduce the capacity of the liquid in a space from the vibrating plate 415 to the nozzle 74, it is possible to reduce the pressure loss caused by compressing the liquid itself, and thus, it is possible to improve the pressure transmission efficiency of the pressure applied by the actuator 411, and the followability of the meniscus to the pressure variation in the liquid chamber.

Modified Example 3

Figure 11:
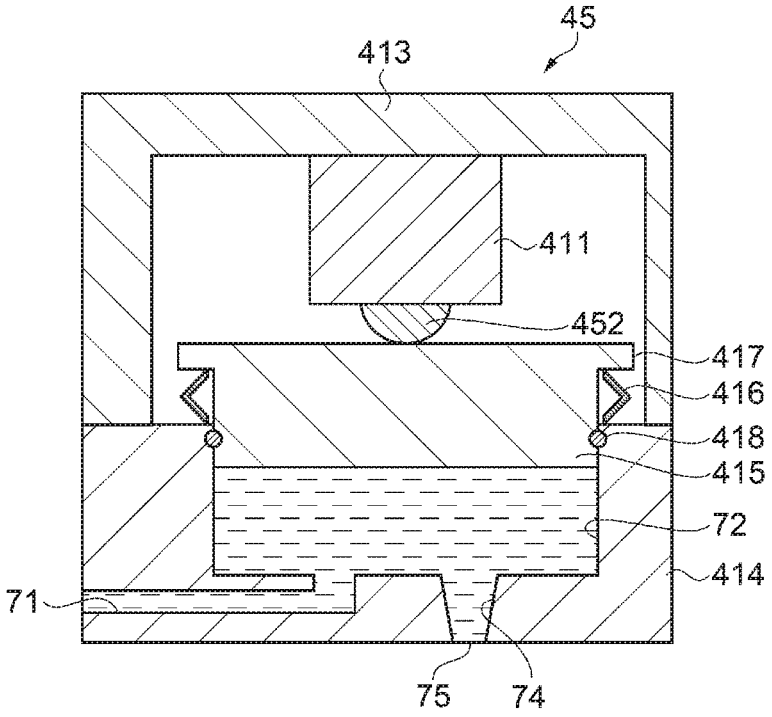
FIG. 11 is a diagram for explaining a schematic configuration of a droplet discharge head according to Modified Example 3.

FIG. 11 is a diagram for explaining a schematic configuration of a droplet discharge head 45 according to Modified Example 3. In Embodiment 1 described above, there is adopted the configuration in which the actuator 411 and the vibrating plate 415 have direct contact with each other. In contrast, it is possible for the actuator 411 in Modified Example 3 to have contact with the vibrating plate 415 via a protruding part 452. The protruding part 452 is a hemisphere having a curved surface. The protruding part 452 is formed of, for example, ceramic. It should be noted that in this case, the tip part 412 of the actuator 411 denotes the protruding part 452. Thus, it is possible to prevent the contact area between the tip part 412 of the actuator 411 and the vibrating plate 415 from being shifted, and it is possible to improve the discharge reproducibility.

Modified Example 4

Figure 12A:
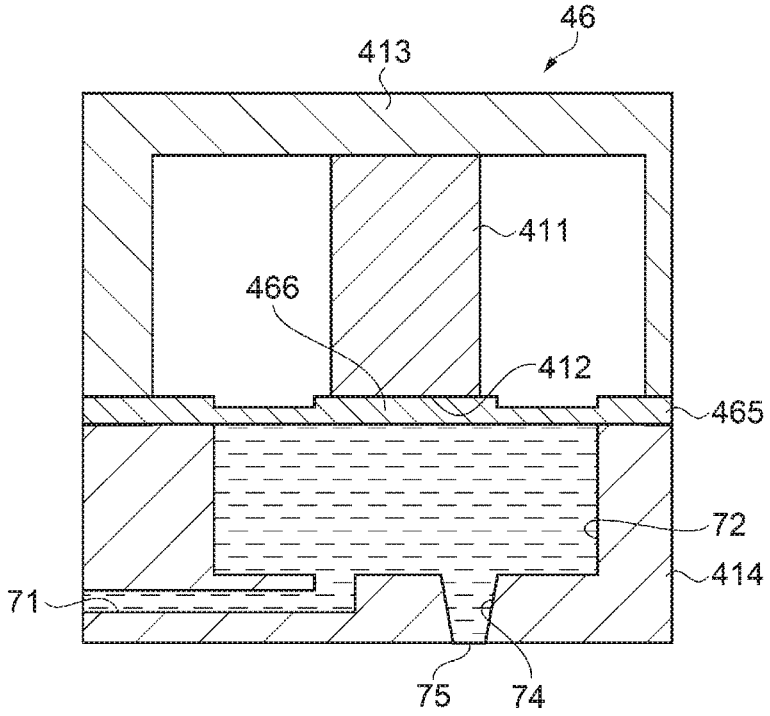
FIG. 12A is a diagram for explaining a schematic configuration of a droplet discharge head according to Modified Example 4.
Figure 12B:
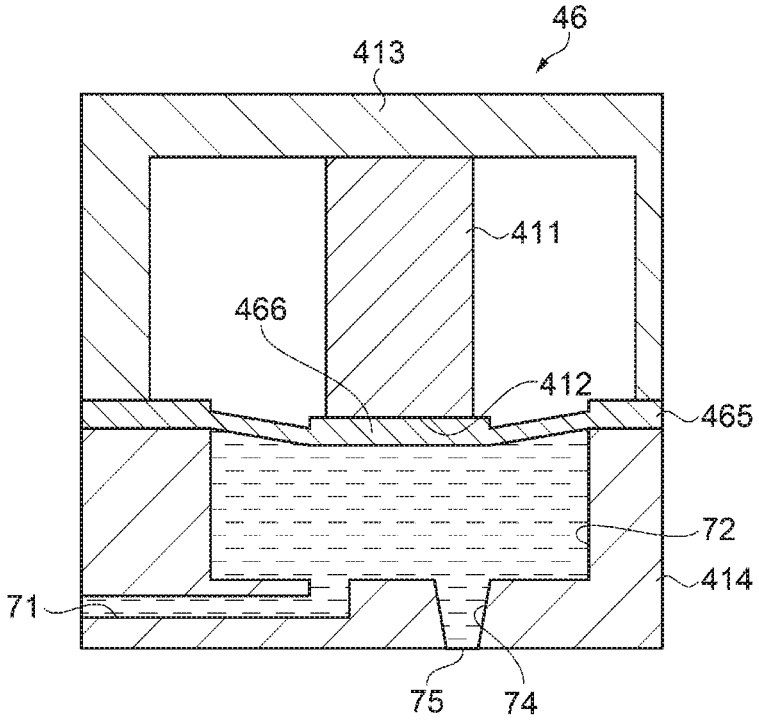
FIG. 12B is a diagram for explaining a schematic configuration of the droplet discharge head according to Modified Example 4.

FIG. 12A and FIG. 12B are diagrams for explaining a schematic configuration of a droplet discharge head 46 according to Modified Example 4. It should be noted that FIG. 12B shows the state in which the control section 6 displaces the tip part 412 of the actuator 411 from the state shown in FIG. 12A toward the first direction. In Embodiment 2 described above, there is adopted the configuration in which the thickness of the vibrating plate 415 is constant, it is also possible for a vibrating plate 465 in Modified Example 4 to have a thick film part 466 to have contact with the actuator 411 disposed on a surface on the opposite side to the liquid chamber 72. The thickness of the thick film part 466 is thicker compared to the thickness of a part other than the thick film part 466 of the vibrating plate 465 constituting the wall surface of the liquid chamber 72. Thus, it is possible to prevent the contact area between the tip part 412 of the actuator 411 and the vibrating plate 465 from being shifted, and it is possible to improve the discharge reproducibility.

Modified Example 5

Although there is presented the description that the droplet discharge head according to each of the embodiments described above has the inflow channel 71 and the nozzle 74, the droplet discharge head can also be communicated with an outflow channel. One opening of the outflow channel is communicated with the liquid chamber 72 or the nozzle 74. Further, the other opening of the outflow channel is communicated with the first tank 7 or the second tank 8. Thus, it is possible to prevent a discharge failure due to an increase in viscosity of the liquid in the liquid chamber 72 or in the nozzle 74, or a discharge failure due to a bubble immixed from the opening 75 of the nozzle 74.

Modified Example 6

It is also possible for the droplet discharge head according to each of the embodiments described above to be provided with a plurality of sets of the nozzle 74, the liquid chamber 72, the vibrating plate 415, and the actuator 411. According to this configuration, substantially the same advantages as described above can be obtained.

Modified Example 7

It is also possible for the actuator 411 in each of the embodiments described above to be formed of a variety of elements for generating a displacement such as an air cylinder, a solenoid, or a magnetostrictor. According to this configuration, substantially the same advantages as described above can be obtained.

Modified Example 8

In the droplet discharge head according to each of the embodiments described above, when the droplet discharge head continuously discharges the droplets (i.e., repeats the timing chart shown in FIG. 5), it is also possible for the control section 6 to further displace the tip part 412 of the actuator 411 toward the first direction in the period t6, and omit the period t0 in the second and subsequent discharge operations. Thus, the discharge intervals between the droplets are shortened, and thus, it is possible to increase the print speed.

Modified Example 9

In the droplet discharge head according to each of the embodiments described above, it is also possible to set the displacement of the tip part 412 of the actuator 411 in the initial state to the intermediate potential. In this case, the period t0 in the sequence of discharge operation is omitted. Further, it is also possible for the control section 6 to perform the process corresponding to the period t0 in the sequence of discharge operation in a period from the startup of the printer 2 to when the drive signal is input to the actuator 411. Thus, it is possible to shorten the time from when the print data is input to the printer 2 to when the droplet is discharged.

Modified Example 10

Although there is presented the description assuming that the conveying mechanism 5 related to Embodiment 1 described above includes the recording medium conveying mechanism 52 and the carriage moving mechanism 51, it is also possible for the conveying mechanism 5 to be a three-dimensional drive stage, and when the droplet discharge head 41 is a line head, it is also possible to omit the carriage moving mechanism 51.

Modified Example 11

Figure 13:
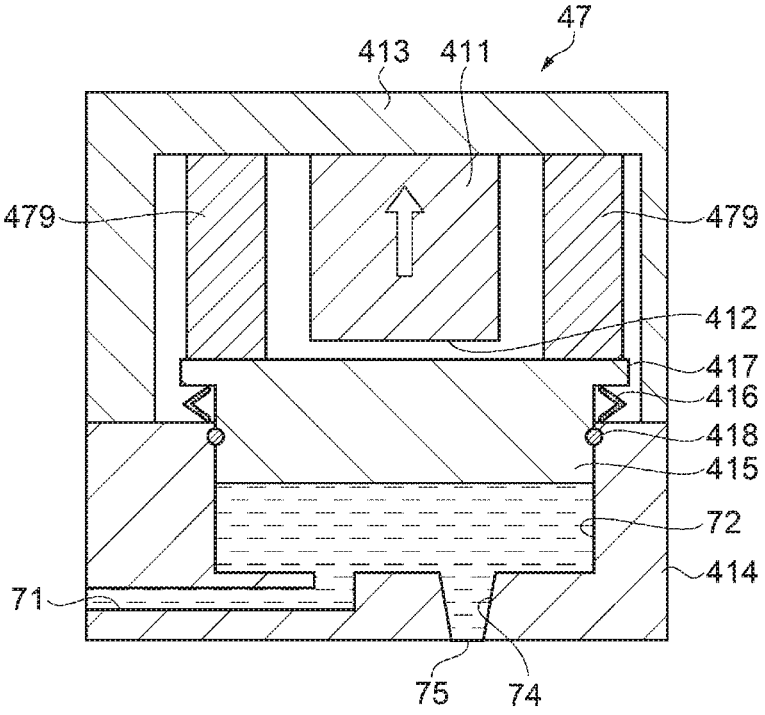
FIG. 13 is a diagram for explaining a schematic configuration of a droplet discharge head according to Modified Example 11.

FIG. 13 is a diagram for explaining a schematic configuration of a droplet discharge head 47 according to Modified Example 11. Modified Example 11 is different from Embodiment 1 in the point that a restraining part 479 fixed to the fixation plate 413 is provided. The restraining part 479 is, for example, a block member made of metal. The restraining part 479 restrains the displacement in the second direction of the vibrating plate 415. In other words, it is possible to define an upper limit value of the displacement toward the second direction of the vibrating plate 415. Therefore, the reproducibility of the pressure variation of the liquid chamber 72 in the pull-in process, and the reproducibility of the pull-in amount of the meniscus MC on the central axis C of the nozzle 74 are improved. Thus, the collision position between the tip part 412 of the actuator 411 and the vibrating plate 415 can be kept constant, and therefore, it is possible to improve the discharge reproducibility. It should be noted that when applying the restraining part 479 in Modified Example 11 to Embodiment 2, substantially the same advantages can be obtained.

Hereinafter, the contents derived from the embodiments will be described.

The droplet discharge head is a droplet discharge head to be mounted on a droplet discharge device provided with a control section configured to perform discharge control of a liquid as a droplet including a nozzle configured to discharge the liquid, a liquid chamber communicated with the nozzle, an inflow channels configured to supply the liquid chamber with the liquid, a vibrating plate constituting a part of a wall surface of the liquid chamber, and an actuator which can extend and contract to apply pressure to the liquid chamber via the vibrating plate, wherein defining a direction in which the vibrating plate is displaced so as to decrease a capacity of the liquid chamber as a first direction, and a direction in which the vibrating plate is displaced so as to increase the capacity of the liquid chamber as a second direction, in an initial state in which a tip part of the actuator has contact with the vibrating plate, and the actuator pushes the vibrating plate toward the first direction, based on a drive signal from the control section, the tip part of the actuator displaces the vibrating plate toward the second direction in a state of having contact with the vibrating plate to thereby pull in a meniscus in the nozzle toward the liquid chamber compared to the meniscus in the nozzle in the initial state, then, the tip part of the actuator is separated from the vibrating plate to further displace the vibrating plate toward the second direction, and then, the tip part of the actuator collides with the vibrating plate to thereby displace the vibrating plate toward the first direction to discharge the liquid from the nozzle.

According to this configuration, since it is possible to supply a large amount of energy to the liquid in the liquid chamber by making the actuator collide with the vibrating plate, it is possible to prevent the pull-in amount of the meniscus in the nozzle from becoming large. Thus, it is possible to prevent the pressure in the liquid chamber from being rapidly reduced, and it is possible to reduce the occurrence of the bubbles in the liquid chamber. Therefore, it is possible to provide the droplet discharge head which prevents the bubbles from occurring, and is capable of stably discharging a high-viscosity liquid.

The droplet discharge head described above may further include an elastic body configured to apply a force in the second direction to the vibrating plate.

When the vibrating plate for changing the capacity of the liquid chamber by the flexural deformation of the vibrating plate itself increases the capacity variation of the liquid chamber, it is necessary to increase the area of the vibrating plate for forming the wall surface of the liquid chamber so that the displacement of the vibrating plate does not exceed the break strength of the vibrating plate. In other words, it is necessary to increase the capacity of the liquid chamber. In contrast, according to this configuration, since the capacity variation of the liquid chamber is caused by the displacement of the elastic body, it is possible to change the capacity variation of the liquid chamber without increasing the area of the vibrating plate forming the wall surface of the liquid chamber, and thus, it is possible to increase the design freedom.

The elastic body of the droplet discharge head described above may constitute a part of the wall surface of the liquid chamber.

According to this configuration, when driving the actuator to reduce the pressure in the liquid chamber, it is possible for the liquid chamber not only to increase the capacity in the second direction, but also to increase the capacity in a third direction perpendicular to the second direction. Therefore, it is possible to increase the capacity variation without changing the capacity of the liquid chamber. Thus, it becomes possible to achieve reduction in size and an increase in density of the droplet discharge head. Further, since it is possible to reduce the capacity of the liquid in a space from the vibrating plate to the nozzle, it is possible to reduce the pressure loss caused by compressing the liquid itself, and thus, it is possible to improve the pressure transmission efficiency of the pressure applied by the actuator, and the followability of the meniscus to the pressure variation in the liquid chamber.

The vibrating plate of the droplet discharge head described above may be a diaphragm.

According to this configuration, since the seal member and the elastic body are not required, it is possible to simplify the configuration.

The vibrating plate of the droplet discharge head described above may have a thick film part having contact with the actuator and disposed on a surface on an opposite side to the liquid chamber.

According to this configuration, since a region where the vibrating plate and the actuator have contact with each other becomes difficult to deform, it is possible to prevent the contact region between the actuator and the vibrating plate from being shifted in accordance with the deflection amount of the vibrating plate, and thus, it is possible to improve the discharge reproducibility.

In the droplet discharge head described above, when the meniscus in the nozzle is pulled in toward the liquid chamber compared to the initial state, a diameter of a pseudo nozzle may be no less than ¼ and no more than ⅔ of a diameter of the nozzle.

According to this configuration, it is possible to prevent the liquid in the liquid chamber from inflowing between the meniscus thus pulled in and the nozzle wall surface, and the energy supplied from the actuator to the liquid in the liquid chamber is concentrated into the center of the nozzle, and it is possible to efficiently reverse the meniscus on the central axis of the nozzle.

The droplet discharge head described above may further include an outflow channel through which the liquid in either the liquid chamber or the nozzle is exhausted without passing through an opening of the nozzle.

According to this configuration, it is possible to prevent a discharge failure due to an increase in viscosity of the liquid in the liquid chamber or in the nozzle, or a discharge failure due to a bubble immixed from the opening of the nozzle.

The droplet discharge control method of the droplet discharge device is a droplet discharge control method of a droplet discharge device including a droplet discharge head having a nozzle configured to discharge the liquid, a liquid chamber communicated with the nozzle, an inflow channel configured to supply the liquid chamber with the liquid, a vibrating plate constituting a part of a wall surface of the liquid chamber, and an actuator which can extend and contract to apply pressure to the liquid chamber via the vibrating plate, a first tank configured to supply the liquid to the droplet discharge head via the inflow channel, a conveying mechanism configured to move the droplet discharge head and a recording medium relatively to each other, and a control section configured to control the droplet discharge head and the conveying mechanism, the method including an initial state forming step of making, by the control section, a tip part of the actuator has contact with the vibrating plate, and the actuator push the vibrating plate toward a first direction defining a direction in which the vibrating plate is displaced so as to decrease a capacity of the liquid chamber as the first direction, and a direction in which the vibrating plate is displaced so as to increase the capacity of the liquid chamber as a second direction, a pull-in step of making, by the control section, the tip part of the actuator displace the vibrating plate toward the second direction in a state of having contact with the vibrating plate to thereby pull in a meniscus in the nozzle toward the liquid chamber compared to the meniscus in the nozzle in the initial state forming step, a separation step of separating, by the control section, the tip part of the actuator from the vibrating plate to further displace the vibrating plate toward the second direction, and a discharge step of making, by the control section, the tip part of the actuator collides with the vibrating plate to thereby displace the vibrating plate toward the first direction to discharge the liquid from the nozzle.

According to this configuration, since it is possible to supply a large amount of energy to the liquid in the liquid chamber by making the actuator collide with the vibrating plate, it is possible to prevent the pull-in amount of the meniscus in the nozzle from becoming large. Therefore, according to this configuration, it is possible to prevent the pressure in the liquid chamber from being rapidly reduced, and it is possible to reduce the occurrence of the bubbles in the liquid chamber. Therefore, it is possible to provide the droplet discharge head which prevents the bubbles from occurring, and is capable of stably discharging a high-viscosity liquid.

In the droplet discharge control method of the droplet discharge device described above, in the discharge step, after making the actuator and the vibrating plate collide with each other, the control section may further displace the vibrating plate toward the first direction in a state in which the actuator and the vibrating plate have contact with each other to discharge the liquid.

According to this configuration, by the actuator further supplying the energy to the liquid in the liquid chamber, the liquid column formed by reversing the meniscus is accelerated, and thus, it is possible to increase the droplet discharge speed.

The droplet discharge device includes the droplet discharge head described above, a first tank configured to supply the liquid to the droplet discharge head via the inflow channel, a conveying mechanism configured to move the droplet discharge head and a recording medium relatively to each other, and a control section configured to control the droplet discharge head and the conveying mechanism.

According to this configuration, since it is possible to supply a large amount of energy to the liquid in the liquid chamber by making the actuator collide with the vibrating plate, it is possible to prevent the pull-in amount of the meniscus in the nozzle from becoming large. Therefore, according to this configuration, it is possible to prevent the pressure in the liquid chamber from being rapidly reduced, and it is possible to reduce the occurrence of the bubbles in the liquid chamber. Therefore, it is possible to provide the droplet discharge device which prevents the bubbles from occurring, and is capable of stably discharging a high-viscosity liquid.

What is claimed is:

1. A droplet discharge head to be mounted on a droplet discharge device provided with a control section configured to perform discharge control of a liquid as a droplet, the droplet discharge head comprising:

a nozzle configured to discharge the liquid;

a liquid chamber communicated with the nozzle;

an inflow channel configured to supply the liquid chamber with the liquid;

a vibrating plate constituting a part of a wall surface of the liquid chamber; and an actuator which can extend and contract to apply pressure to the liquid chamber via the vibrating plate, wherein defining a direction in which the vibrating plate is displaced so as to decrease a capacity of the liquid chamber as a first direction, and a direction in which the vibrating plate is displaced so as to increase the capacity of the liquid chamber as a second direction, in an initial state in which a tip part of the actuator has contact with the vibrating plate, and the actuator pushes the vibrating plate toward the first direction, based on a drive signal from the control section, the tip part of the actuator displaces the vibrating plate toward the second direction in a state of having contact with the vibrating plate to thereby pull in a meniscus in the nozzle toward the liquid chamber compared to the meniscus in the nozzle in the initial state, then, the tip part of the actuator is separated from the vibrating plate to further displace the vibrating plate toward the second direction, and then, the tip part of the actuator collides with the vibrating plate to thereby displace the vibrating plate toward the first direction to discharge the liquid from the nozzle.

2. The droplet discharge head according to claim 1, further comprising:

an elastic body configured to apply a force in the second direction to the vibrating plate.

3. The droplet discharge head according to claim 2, wherein the elastic body constitutes a part of a wall surface of the liquid chamber.

4. The droplet discharge head according to claim 1, wherein the vibrating plate is a diaphragm.

5. The droplet discharge head according to claim 4, wherein the vibrating plate has a thick film part having contact with the actuator and disposed on a surface on an opposite side to the liquid chamber.

6. The droplet discharge head according to claim 1, wherein when the meniscus in the nozzle is pulled in toward the liquid chamber compared to the initial state, a diameter of a pseudo nozzle is no less than ¼ and no more than ⅔ of a diameter of the nozzle.

7. The droplet discharge head according to claim 1, further comprising:

an outflow channel through which the liquid in either the liquid chamber or the nozzle is exhausted without passing through an opening of the nozzle.

8. A droplet discharge control method of a droplet discharge device including a droplet discharge head having a nozzle configured to discharge the liquid, a liquid chamber communicated with the nozzle, an inflow channel configured to supply the liquid chamber with the liquid, a vibrating plate constituting a part of a wall surface of the liquid chamber, and an actuator which can extend and contract to apply pressure to the liquid chamber via the vibrating plate, a first tank configured to supply the liquid to the droplet discharge head via the inflow channel, a conveying mechanism configured to move the droplet discharge head and a recording medium relatively to each other, and a control section configured to control the droplet discharge head and the conveying mechanism, the method comprising:

an initial state forming step of making, by the control section, a tip part of the actuator has contact with the vibrating plate, and the actuator push the vibrating plate toward a first direction defining a direction in which the vibrating plate is displaced so as to decrease a capacity of the liquid chamber as the first direction, and a direction in which the vibrating plate is displaced so as to increase the capacity of the liquid chamber as a second direction;

a pull-in step of making, by the control section, the tip part of the actuator displaces the vibrating plate toward the second direction in a state of having contact with the vibrating plate to thereby pull in a meniscus in the nozzle toward the liquid chamber compared to the meniscus in the nozzle in the initial state forming step;

a separation step of separating, by the control section, the tip part of the actuator from the vibrating plate to further displace the vibrating plate toward the second direction; and a discharge step of making, by the control section, the tip part of the actuator collides with the vibrating plate to thereby displace the vibrating plate toward the first direction to discharge the liquid from the nozzle.

9. The droplet discharge control method of the droplet discharge device according to claim 8, wherein in the discharge step, after making the actuator and the vibrating plate collide with each other, the control section further displaces the vibrating plate toward the first direction in a state in which the actuator and the vibrating plate have contact with each other to discharge the liquid.

10. A droplet discharge device comprising:

the droplet discharge head according to claim 1;

a first tank configured to supply the liquid to the droplet discharge head via the inflow channel;

a conveying mechanism configured to move the droplet discharge head and a recording medium relatively to each other; and a control section configured to control the droplet discharge head and the conveying mechanism.

* * * * *